US007422468B2

(12) United States Patent
Shuey

(10) Patent No.: US 7,422,468 B2
(45) **Date of Patent: *Sep. 9, 2008**

(54) ELECTRICAL CONTACT WITH STAPLED CONNECTION

(75) Inventor: Joseph B. Shuey, Camp Hill, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/800,297

(22) Filed: May 3, 2007

(65) Prior Publication Data

US 2007/0270020 A1 Nov. 22, 2007

Related U.S. Application Data

(63) Continuation of application No. 11/435,797, filed on May 16, 2006.

(51) Int. Cl.
*H01R 4/24* (2006.01)

(52) U.S. Cl. ..... 439/422; 439/421

(58) Field of Classification Search ..... 439/421–423
See application file for complete search history.

(56) References Cited

U.S. PATENT DOCUMENTS

| | | | | |
|---|---|---|---|---|
| 2,302,767 A | | 11/1942 | Hackbarth | 173/269 |
| 3,077,027 A | | 2/1963 | Sola et al. | 29/155.55 |
| 3,197,729 A | | 7/1965 | Sarazen | 439/422 |
| 3,335,392 A | | 8/1967 | Elliott | 339/97 |
| 3,395,381 A | | 7/1968 | Huffnagle | 339/97 |
| 3,715,457 A | * | 2/1973 | Teagno et al. | 174/88 R |
| 3,880,488 A | * | 4/1975 | Collier et al. | 439/410 |
| 3,924,917 A | | 12/1975 | Munshower | 339/17 |
| 3,937,403 A | | 2/1976 | Lawson | 339/97 |
| 3,997,233 A | | 12/1976 | Evans | 339/97 |
| 4,066,319 A | | 1/1978 | Baker et al. | 339/97 |
| 4,082,402 A | | 4/1978 | Kinkaid et al. | 339/97 |
| 4,106,836 A | | 8/1978 | Asick et al. | 339/97 |
| 4,357,065 A | | 11/1982 | Kam et al. | 439/422 |
| 4,560,224 A | | 12/1985 | Weisenburger | 339/97 |
| 4,749,368 A | | 6/1988 | Mouissie | 439/421 |
| 4,834,673 A | | 5/1989 | Beinhaur et al. | 439/422 |
| 4,957,453 A | | 9/1990 | Owen | 439/422 |

(Continued)

FOREIGN PATENT DOCUMENTS

WO WO-2005/006499 A1 1/2005

(Continued)

*Primary Examiner*—Tho D. Ta
*Assistant Examiner*—Travis Chambers
(74) *Attorney, Agent, or Firm*—Harrington & Smith, PC

(57) ABSTRACT

A flexible flat connector cable electrical contact including a first connection section adapted to be connected to an electrical conductor of a flexible flat conductor (FFC) cable; and a second connection section electrical coupled to the first connection section and adapted to be electrically connected to another member. The first connection section includes at least one staple feature having a hole and only two outwardly extending lances at the hole. Each lance has a pointed tip adapted to pierce through the electrical conductor of the FFC cable. The lances are adapted to be deformed back towards the electrical conductor to form a stapled connection of the first connection section to the FFC cable with only the two lances at the staple feature.

22 Claims, 5 Drawing Sheets

U.S. PATENT DOCUMENTS

| | | | | |
|---|---|---|---|---|
| 5,078,617 | A | 1/1992 | Gutierrez et al. | 439/422 |
| 5,137,468 | A | 8/1992 | Murakami | 439/422 |
| 5,228,861 | A | 7/1993 | Grabbe | 439/66 |
| 5,833,488 | A | 11/1998 | Roy et al. | 439/423 |
| 6,217,348 | B1 | 4/2001 | Lin et al. | 439/83 |
| 6,267,618 | B1 | 7/2001 | Hio | 439/422 |
| 6,312,283 | B1 | 11/2001 | Hio | 439/422 |
| 6,341,980 | B1 | 1/2002 | Hio et al. | 439/422 |
| 6,364,691 | B1 | 4/2002 | Hio | 439/422 |
| 6,375,474 | B1 | 4/2002 | Harper, Jr. et al. | 439/66 |
| 6,439,921 | B1 | 8/2002 | Hio | 439/422 |
| 6,467,164 | B2 | 10/2002 | Aoyama | 29/866 |
| 6,626,695 | B2 | 9/2003 | Enomoto et al. | 439/422 |
| 6,718,815 | B2 * | 4/2004 | Fantini | 72/412 |
| 6,726,502 | B1 | 4/2004 | Hayes | 439/422 |
| 6,736,664 | B2 | 5/2004 | Ueda et al. | 439/423 |
| 6,799,990 | B2 | 10/2004 | Wendling et al. | 439/422 |
| 6,842,976 | B2 | 1/2005 | Enomoto et al. | 29/845 |
| 7,047,636 | B2 * | 5/2006 | Onuma | 29/844 |
| 2001/0009820 | A1 | 7/2001 | Nagai | 439/422 |
| 2003/0008548 | A1 | 1/2003 | Ueda et al. | 439/422 |

FOREIGN PATENT DOCUMENTS

| | | | |
|---|---|---|---|
| WO | WO-2005/008837 | A1 | 1/2005 |
| WO | WO 2007/0068280 | A1 | 6/2007 |

* cited by examiner

ELECTRICAL CONTACT WITH STAPLED CONNECTION

CROSS REFERENCE TO RELATED APPLICATION

This is a continuation patent application of U.S. patent application Ser. No. 11/435,797 filed May 16, 2006.

BACKGROUND OF THE INVENTION

1. Field of the Invention

The invention relates to an electrical connector and, more particularly, to an electrical connector which is adapted to pierce through a flexible flat conductor cable.

2. Brief Description of Prior Developments

Flex cables, such as flexible flat conductor (FFC) cable, also known as flexible printed circuit (FPC) cables, are generally well known in the art. U.S. Pat. No. 4,749,368 discloses a contact strip terminal which can be attached to a flex cable.

Known flex cable electrical contacts or terminal products use conductor piercing types of connections. This is extremely good and desirable for space considerations as well as good electrical contact and precise locationing. However, conductor piercing types of flex cable connections are limited in their ability to address (terminate to) a flex cable where the thickness of the conductor exceeds 0.006 inch thickness. There is a need for a flex cable contact which can be attached to a flex cable where the conductor thickness is 0.008 inch and greater.

A current solution is to remove the insulation from the flex cable and crimp individual conductor 'Wire Type' connectors to the conductors. There is a need for a flex cable electrical contact which can be attached to a conductor of a flex cable without the need for removing insulation from the flex cable before the connection, but still use a conductor piercing type of connection rather than an individual conductor 'Wire Type' connectors.

SUMMARY OF THE INVENTION

In accordance with one aspect of the invention, a flexible flat connector cable electrical contact is provided including a first connection section adapted to be connected to an electrical conductor of a flexible flat conductor (FFC) cable; and a second connection section electrical coupled to the first connection section and adapted to be electrically connected to another member. The first connection section includes at least one staple feature having a hole and only two outwardly extending lances at the hole. Each lance has a pointed tip adapted to pierce through the electrical conductor of the FFC cable. The lances are adapted to be deformed back towards the electrical conductor to form a stapled connection of the first connection section to the FFC cable with only the two lances at the staple feature.

In accordance with another aspect of the invention, a flexible flat connector cable electrical contact is provided comprising a first connection section adapted to be connected to an electrical conductor of a flexible flat conductor (FFC) cable; and a second connection section electrically coupled to the first connection section and adapted to be electrically connected to another member. The first connection section comprises a substantially flat main section with at least one staple feature comprising only two lances. Each lance is connected to the main section by a bend and extends generally straight outward relative to the main section from the bend in a same direction with a hole between the lances. Each lance has a tip with a general knife edge. Each lance has a general flat shape with a uniform cross section except at the general knife edge and the bend. The lances are adapted to pierce through the electrical conductor of the FFC cable with the knife edges and be deformed back towards the electrical conductor to form a stapled connection of the first connection section to the FFC cable with only the two lances of the staple feature.

In accordance with one method of the invention, a method of forming a flexible flat connector cable electrical contact is provided comprising forming a first connection section of the electrical contact with a staple feature comprising stamping a substantially flat main section of the electrical contact to form a hole and only two outwardly extending lances at the hole, wherein each lance extends from the main section at a bend and has a distal tip with a knife edge and a general flat shape with a uniform cross section except at the edge and the bend; and forming a second connection section, connected to the first connection section, which is adapted to electrically and mechanically connect to another member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
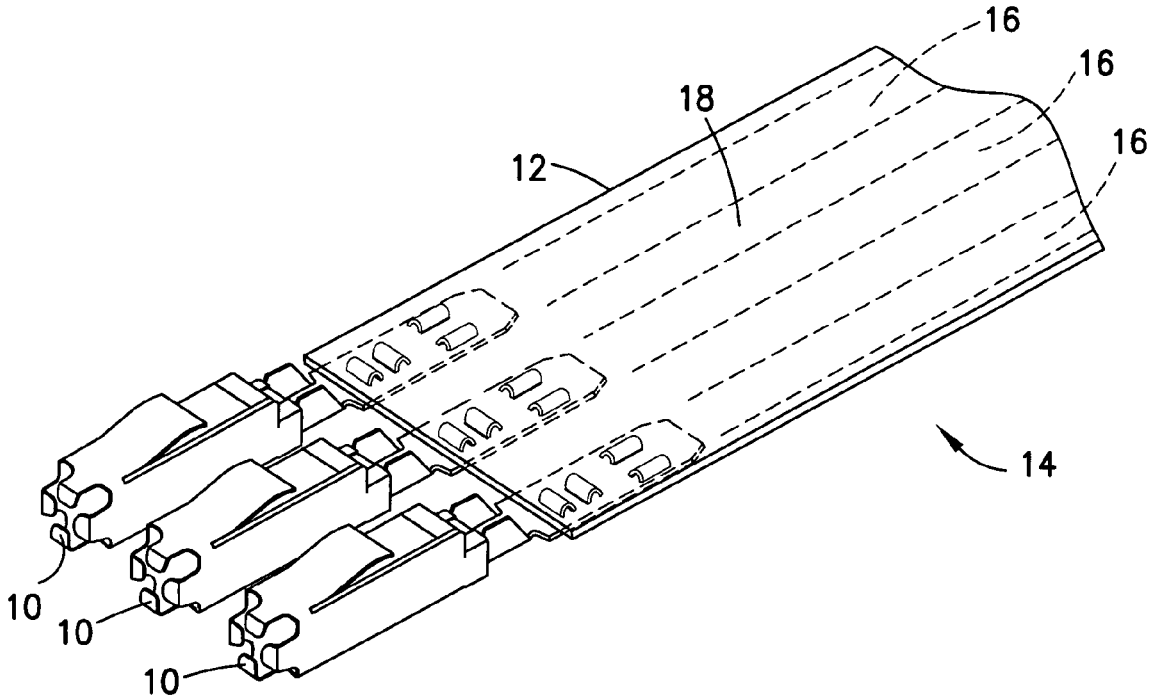
FIG. 1 is a perspective view of an assembly of a flex cable with electrical contacts comprising features of the invention.

Referring to FIG. 1, there is shown a perspective view of electrical contacts or terminals 10, incorporating features of the invention, shown attached to a flex cable 12 to form an assembly 14. Although the invention will be described with reference to the exemplary embodiment shown in the drawings, it should be understood that the invention can be embodied in many alternate forms of embodiments. In addition, any suitable size, shape or type of elements or materials could be used.

Figure 2:
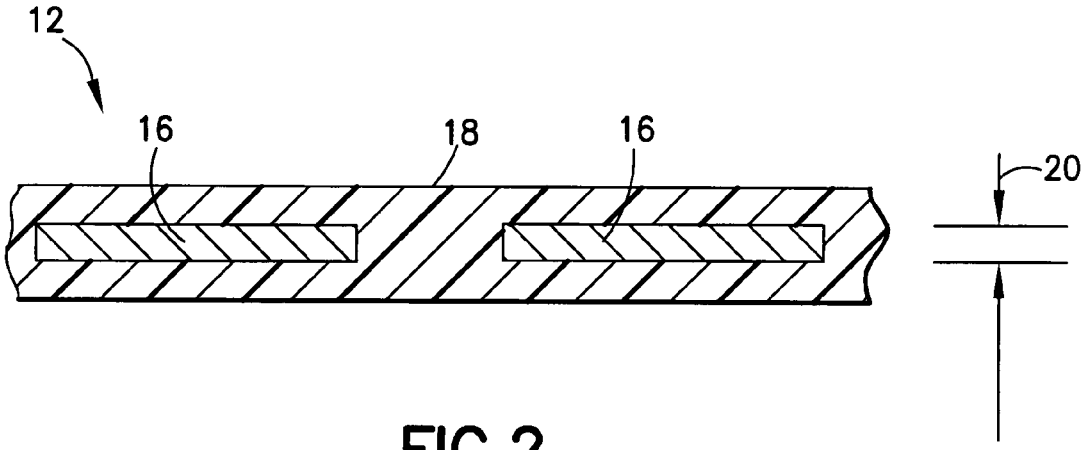
FIG. 2 is a partial cross sectional view of the flex cable shown in FIG. 1.

The contacts 10 are preferably inserted into a housing (not shown) to form an electrical connector attached to the flex cable 12. Referring also to FIG. 2, the flex cable 12 generally comprises electrical conductors 16 and an electrically insulating cover 18. The conductors 16 have a general flat shape and are located in a spaced side-by-side location forming a generally flat cable 12. In the past, as noted above, the thickness 20 of the conductors was about 0.006 inch or less when intended to be used with piercing types of connections, similar to those disclosed in U.S. Pat. No. 4,749,368 for example. However, features of the invention are adapted to be used with conductors having a thickness 20 of 0.008 inch or more as well as less than 0.008 inch.

Figure 3:
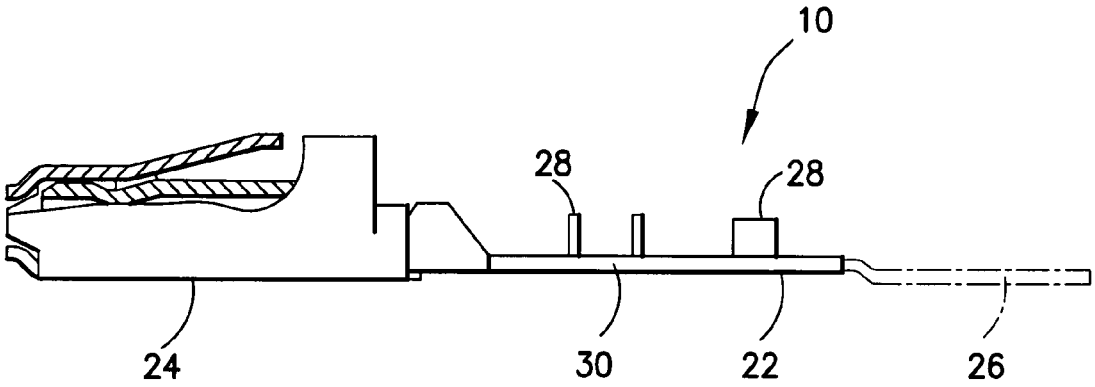
FIG. 3 is an elevational side view of one of the contacts shown in FIG. 1.
Figure 4:
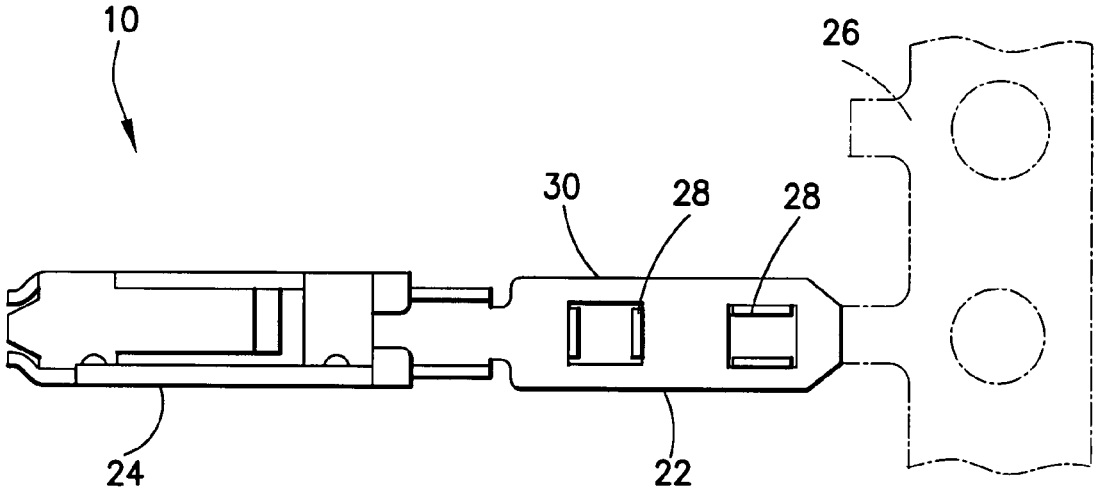
FIG. 4 is a top plan view of the contact shown in FIG. 3.

Referring also to FIGS. 3 and 4, each contact 10 generally comprises a first connection section 22 and a second connection section 24. In a preferred embodiment the contact 10 is comprised of a sheet metal member which is stamped and formed into the shape shown. The contact 10 can be formed with a plurality of other similar contact on a carry strip 26. The first and second connection sections are electrically coupled to each other.

The first connection section 22 is adapted to mechanically and electrically connect the contact 10 to the flex cable 12. The second connection section 24 is adapted to electrically connect to another member, such as a contact of a mating electrical connector for example. In the embodiment shown the second connection section 24 comprises a female connection section adapted to receive a male contact of the mating electrical connector. However, in an alternate embodiment, any suitable type of second connection section could be provided including, for example, a male connection section or a connection section similar to the first connection section.

In the embodiment shown, the first connection section 22 has a main section 30 and two staple features 28. The main section 30 is substantially flat. The front staple feature 28 is orientated 90° rotated relative to the rear staple feature, but in an alternate embodiment, the two staple features might not be rotated relative to each other. In addition, although the first connection section 22 is described as having two staple features 28, in an alternate embodiment the first connection section 22 could have more than two staple features or less than two staple features. In another alternate embodiment, a first connection section could be provided with one or more of the staple features 28 and other connection features such as the teeth groups described in U.S. Pat. No. 4,749,368 which is hereby incorporated by reference in its entirety.

Figure 5:
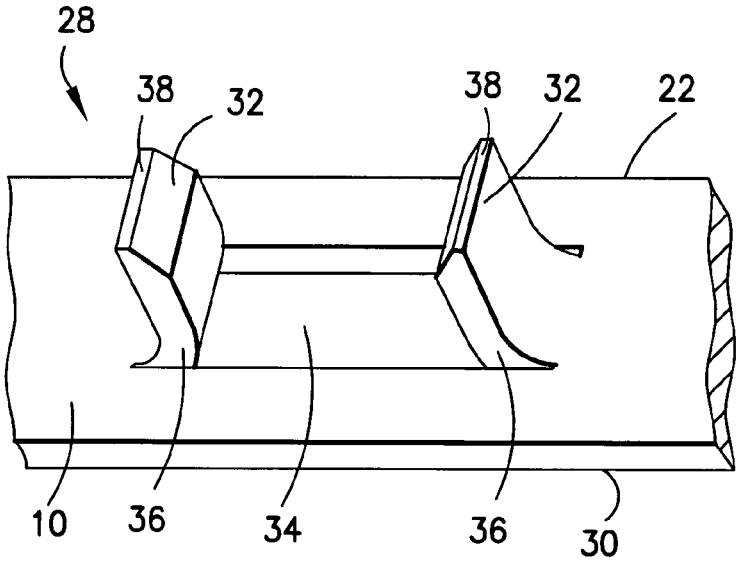
FIG. 5 is a partial perspective view of one of the staple features of the contact shown in FIGS. 3-4.

Referring also to FIG. 5, each staple feature 28 generally comprises only two lances 32. The lances 32 are formed by stamping the main section 30 to form the lances. A hole 34 is formed during this stamping process. Thus, the lances 32 are formed integral with the main section 30, and easily formed without a complicated formation process. In this embodiment the lances are formed on opposite ends of the hole 34. Each lance 32 is connected to the main section 30 by a bend 36. The lances 32 extends generally straight outward relative to the main section 30 from the bends 36 in a same direction with the hole 34 between the lances. Each lance 32 has a tip 38 with a general knife edge. In an alternate embodiment, a piercing tip or end shape, other than a knife edge, could be provided. Each lance 32 has a general flat shape with a uniform cross section except at the general knife edge 38 and the bend 36. As further described below, the lances 32 are adapted to pierce through one of the electrical conductors 16 of the flex cable 12 with the knife edges, and the lances are deformed back towards the electrical conductor to form a stapled connection of the first connection section to the flex cable with only the two lances at each staple feature.

Figure 6:
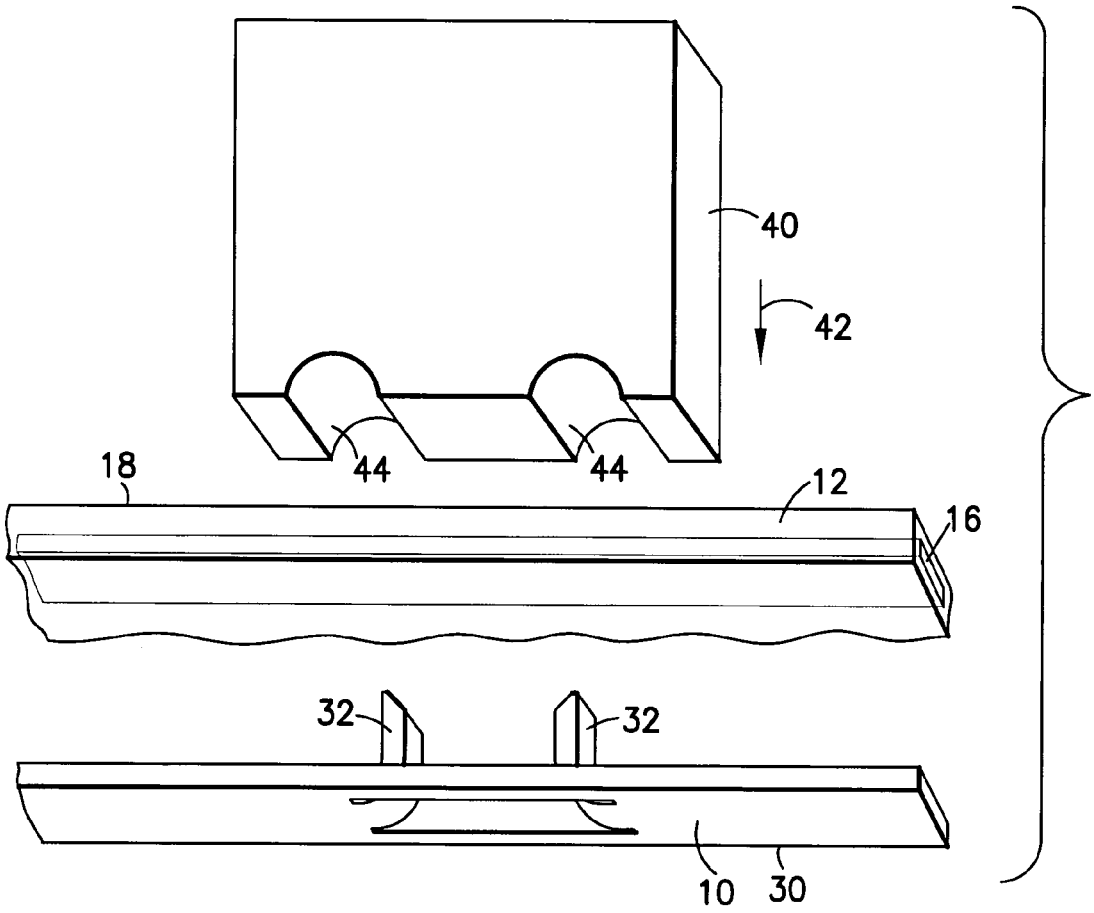
FIG. 6 is a perspective view showing positioning of the contact, flex cable and a stapling die used to connect the contact to the flex cable.
Figure 7:
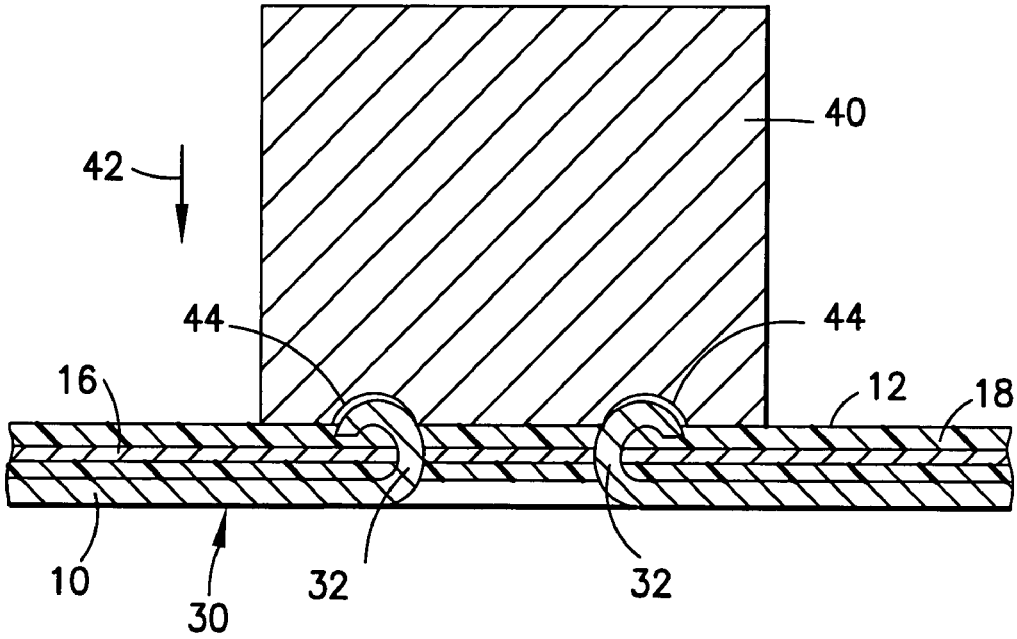
FIG. 7 is a cross sectional view showing how the stapling die deforms the lances of the contact to staple connect the contact to the flex cable.
Figure 8:
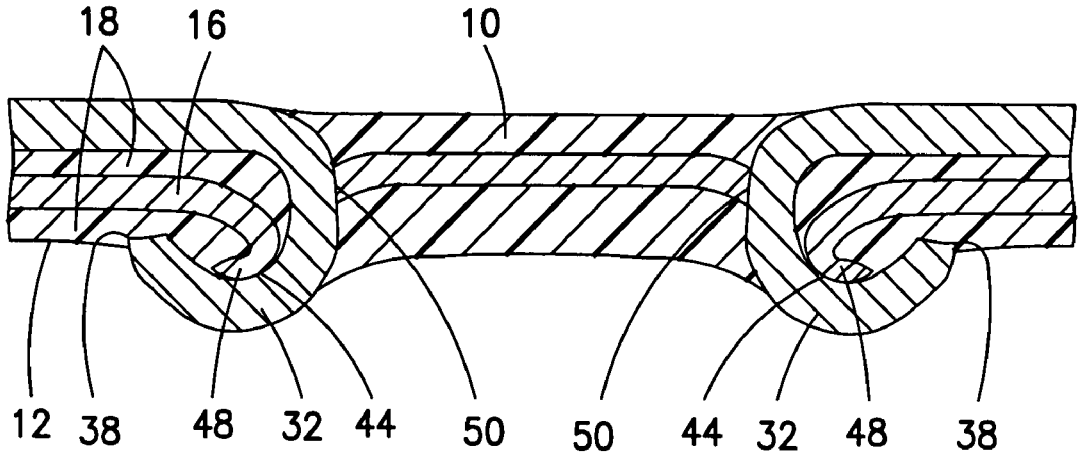
FIG. 8 is an enlarged cross sectional view showing the staple connection of the lances of the contact to the flex cable.

Referring now to FIGS. 6-8, connection of one of the contacts 10 to the flex cable 12 will be described. The connection process uses a stapling die 40. The flex cable 12 is located between the die 40 and the contact 10. The die 40 comprises two staple forming recesses 44. The recesses 44 have a general curved shape. The die 40 is pressed towards the contact 10 as indicated by arrow 42. This enables the lances 32 to pierce through the cover 18 and conductor 26 to contact the recesses 44. With further pressing of the die 44 towards the main section 30 of the contact 10, the lances 32 are deformed into general curved shapes as seen in FIGS. 7 and 8. More specifically, the lances 32 are deformed into a general stapled shape with the lances extending outwardly in opposite directions relative to each other. The lances 32 are deformed such that the tips 38 are bent around and back towards the conductor 16. In the embodiment shown, the tips 38 extend back into the cover 18.

As seen best in FIG. 8, as the lances 32 are deformed, they form inwardly curved surfaces 44 and outer surfaces 46. The lances 32 do not merely pierce through the conductor 16, they also deform the conductor 16 for better electrical contact with the lances 32. More specifically, portions 48 of the conductor 16 are bent back such that they form outwardly curved surfaces which contact the inwardly curved surfaces 44 of the lances. This creates an increased area of contact between the lances 32 and the conductor 16 as well as the areas 50 of contact and areas of contact along side edges of the lances.

With the invention, a method of forming a flex cable electrical contact can be provided comprising forming a first connection section of the electrical contact with a staple feature comprising stamping a substantially flat main section of the electrical contact to form a hole and only two outwardly extending lances at the hole, wherein each lance extends from the main section at a bend and has a distal tip with a knife edge and a general flat shape with a uniform cross section except at the edge and the bend; and forming a second connection section, connected to the first connection section, which is adapted to electrically and mechanically connect to another member.

With the invention a method of mechanically and electrically connecting an electrical contact to an electrical conductor of a flex cable can be provided comprising forming an electrical contact as noted above; and stapling the staple feature to the electrical conductor of the flex cable at a connection point without removing outer insulation from the flex cable at the connection point, wherein the two lances pierce through the electrical conductor at the knife edge and are bent back towards the main section to form a stapled connection of the staple feature to the flex cable with the lances forming an electrical connection by outwardly curving portions of the electrical conductor at the connection point contacting against inwardly curving portions of the lances. The lances can be bent in opposite outward directions before being bent back towards the main section.

Unlike a conventional piercing connection, such as described in U.S. Pat. No. 4,749,368, for example, by forming the lances 32 with a knife edge (or at least a pointed tip) and a general flat shape with a uniform cross section except at the edge and the bend, and only two lances, the staple feature has sufficient strength to pierce through larger thickness conductors than the conventional piercers of the prior art. Thus, the insulating cover 18 does not need to be removed and alternative crimped individual conductor 'Wire Type' connectors do not need to be installed. This saves a considerable amount of time and energy during a connection process. This reduction in time and energy results in a cost savings. Thus, a piercing type of connection can be made with flex cables having larger thickness conductors than previously allowed in the art.

Figure 9:
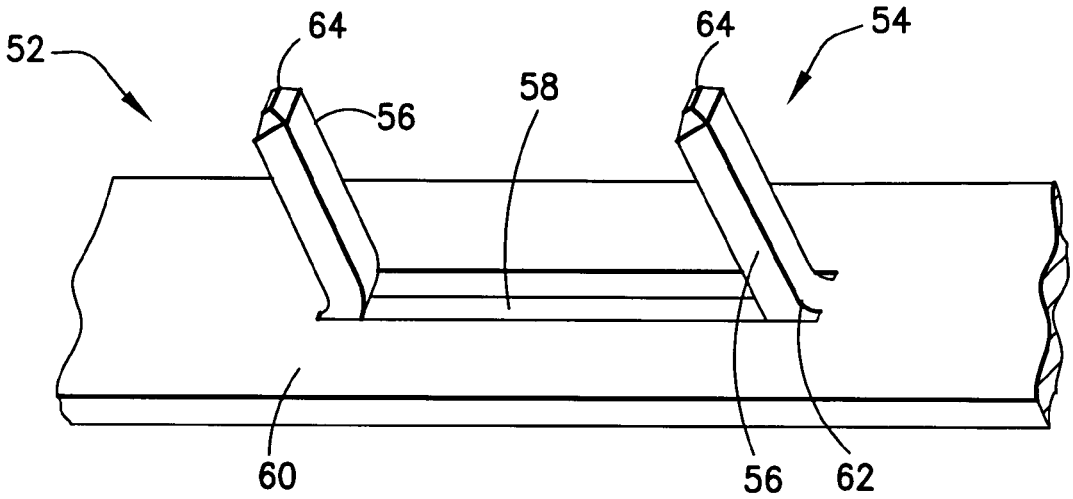
FIG. 9 is a perspective view of a portion of an electrical contact of an alternate embodiment of the invention.
Figure 10:
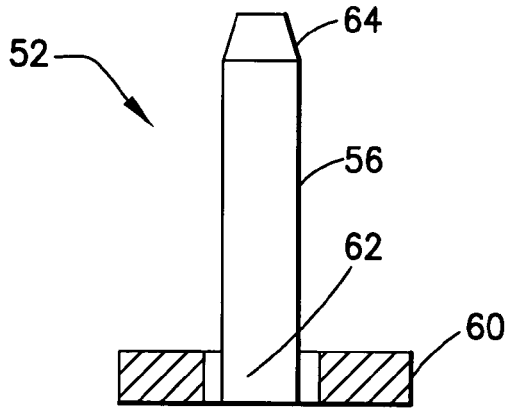
FIG. 10 is an elevational end view of the contact shown in FIG. 9.

Referring also to FIGS. 8-9, an alternate embodiment of the invention is shown. In this embodiment the electrical contact 52 comprises a first connection section 54 that comprises only two lances 56 at opposite ends of a hole 58 in a substantially flat section 60 of the contact. The hole 58 is formed by cutting and bending portions of the flat section 60 to form the lances 56. The lances 56 have a general square cross sectional shape rather than the rectangular cross sectional shape of the lances 32. Each lance 56 extends away from the flat section 60 at a bend 62 in a general cantilever fashion and comprises a distal tip 64. In this embodiment, the distal tip 64 has a general pointed shape with inwardly sloped lateral sides, as well as at least one sloped front and rear sides.

Figure 11:
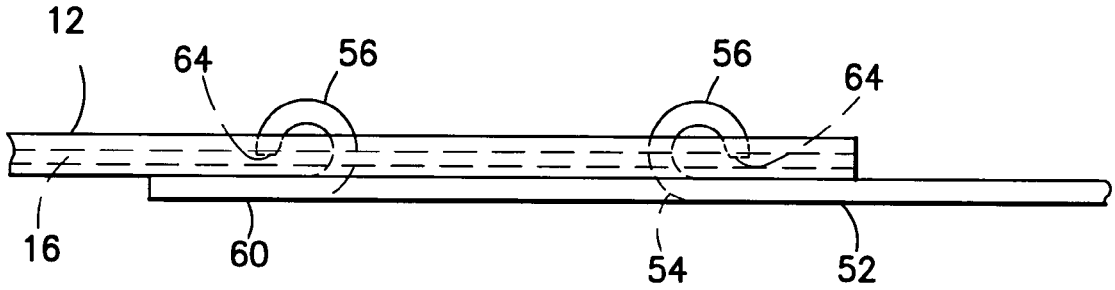
FIG. 11 is a partial elevational side view of the contact shown in FIGS. 9-10 shown attached to a flex cable.

Referring also to FIG. 11, the substantially straight lances 56 are pierced through the cable 12 and are deformed to bend the two lances 56 back towards the flat section 60. The lances 56 pierce through the bottom of the conductor 12 and extend outward from the top of the cable 12. The lances 56 are bent in a general stapled shape with the lances 56 being deformed outwardly relative to each other. The pointed tips 64 extend entirely through the cable 12 and are redirected back into the insulation of the cable 12. In this embodiment the tips 64 pierce back into the conductor 12 at the top side of the conductor. However, in an alternate embodiment the tips 64 might not pierce back into the conductor 12 at the top side of the conductor.

The invention can be used in an automotive application. However, the invention is not limited to automotive applications. An automotive flex connector application with the invention can comprise:

5 amp contacts, such as for a 0.64 mm pin on a 2.54 mm pitch attached to a 100 micron thick copper conductor; or 15 amp contacts, such as for a 0.8 mm×1.5 mm blade attached to a 200 micron thick copper conductor; or 25 amp contacts, such as for a 0.8 mm×2.8 mm blade attached to a 200 or 300 micron thick copper conductor.

Existing pierce through flex cable contacts will not meet the 5 amp need, much less the 15 or 25 amp need. Existing pierce through flex cable contacts generally use Alloy 725 for their material. This material does not provide sufficient column strength to pierce through a 100 micron copper conductor in a flex cable Conductivity for this type of material in a pierce through flex cable contact is also only about 11%. It has been found that use of Alloy 18080 instead of Alloy 725 can have a 80% conductivity. Alloy 18080 has been successfully sampled in a conventional die to form a conventional type of pierce through flex cable contact. The use of Alloy 18080 to form a conventional type of pierce through flex cable contact has been successfully tested for a 100 micron copper conductor in a flex cable because the material has sufficient column strength. However, this does not provide sufficient column strength for a flex cable having a conductor thickness more than 100 microns.

With the invention, on the other hand, the column strength of the lances, as well as the tips of the lances and shapes of the lances, as well as there being only two lances, allows the invention to be used with either Alloy 725 or Alloy 18080 to connect to flex cables having 100, 200 or 300 micro thickness conductors.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A flex cable electrical contact comprising:

a first connection section adapted to be connected to an electrical conductor of a flexible flat conductor (FFC) cable having a thickness of the electrical conductor of about 0.008 inch or more; and a second connection section electrical connected to the first connection section and adapted to be electrically connected to another member, wherein the first connection section comprises at least one staple feature comprises a hole and two outwardly extending lances at the hole, wherein the hole extends entirely through the first connection section, wherein each lance has a general square cross sectional shape, wherein each lance comprises a pointed tip adapted to pierce entirely through insulation and the electrical conductor of the FFC cable, and wherein the lances are adapted to be deformed back towards the electrical conductor to form a stapled connection of the first connection section to the FFC cable with only the lances at the staple feature.

2. An electrical contact as in claim 1 wherein the pointed tip comprises a knife edge.

3. An electrical contact as in claim 1 wherein the first connection section further comprises a main section, and wherein each lance is connected to the main section by a bend and extends generally straight outward relative to the main section from the bend in a same direction.

4. An electrical contact as in claim 1 wherein each lance has a general flat shape with a uniform cross section except at the pointed tip and a base of the lance.

5. An electrical contact as in claim 1 wherein the at least one staple feature comprises at least two spaced staple features.

6. An electrical contact as in claim 1 wherein the lances are adapted to be deformed such that, after the lances are deformed, inwardly curved deformed surfaces of the lances contact outwardly curved deformed surfaces of the electrical conductor.

7. A flex cable electrical contact as in claim 1 wherein the flex cable electrical contact is comprised of a flat sheet metal member which is formed.

8. An electrical contact as in claim 1 wherein the electrical contact is comprised of Alloy 18080.

9. An electrical contact as in claim 1 wherein the first connection section comprises only two of the lances.

10. An electrical contact as in claim 1 wherein the lances are adapted to be deformed in opposite directions away from each other and back towards the electrical conductor to form the stapled connection.

11. A flex cable and electrical contact assembly comprising:

a flexible flat conductor (FFC) cable having an electrical conductor with a thickness of the electrical conductor of about 0.008 inch or more; and an electrical contact as in claim 1 connected to the FFC cable, wherein the lances are deformed such that they comprise inwardly curved deformed surfaces contacting outwardly curved deformed surfaces of the electrical conductor.

12. A flex cable electrical contact comprising:

a first connection section adapted to be connected to an electrical conductor of a flexible flat conductor (FFC) cable having a thickness of the electrical conductor of about 0.008 inch or more; and a second connection section electrically connected to the first connection section and adapted to be electrically connected to another member, wherein the first connection section comprises a substantially flat main section with at least one staple feature comprising only two lances, wherein each lance is connected to the main section by a bend and extends generally straight outward relative to the main section from the bend in a same direction, wherein a hole is provided between the lances at the main section, wherein each bend extends from opposite ends of the hole, wherein each lance has a tip with a general pointed edge, wherein each lance has a general flat shape with a uniform cross section along its height except at the general pointed edge and the bend, and wherein the lances are adapted to pierce entirely through insulation and the electrical conductor of the FFC cable with the pointed edges and be deformed back towards the electrical conductor to form a stapled connection of the first connection section to the FFC cable with only the two lances of the staple feature.

13. A flex cable electrical contact as in claim 12 wherein the lances are adapted to be deformed such that, after the lances are deformed, inwardly curved deformed surfaces of the lances contact outwardly curved deformed surfaces of the electrical conductor.

14. A flex cable electrical contact as in claim 12 wherein the at least one staple feature comprises at least two spaced staple features.

15. A flex cable electrical contact as in claim 12 wherein the electrical contact is comprised of a flat sheet metal member which is formed.

16. A flex cable electrical contact as in claim 12 wherein the general pointed edge comprises a general knife edge.

17. A flex cable electrical contact as in claim 12 wherein the electrical contact is comprised of Alloy 18080.

18. A flex cable electrical contact as in claim 12 wherein the lances are adapted to pierce entirely through the insulation and the electrical conductor of the FFC cable with the pointed edges and be deformed in opposite directions away from each other and back towards the electrical conductor to form the stapled connection.

19. A flex cable electrical contact comprising:

a first connection section adapted to be connected to an electrical conductor of a flexible flat conductor (FFC) cable having a thickness of the electrical conductor of about 0.008 inch or more; and a second connection section electrical connected to the first connection section and adapted to be electrically connected to another member, wherein the first connection section comprises at least one staple feature comprising a hole and outwardly extending lances at opposite ends of the hole, wherein each lance comprises a pointed tip adapted to pierce entirely through the thickness of the electrical conductor of the FFC cable, wherein each lance comprises a first side and a second adjacent side, wherein the first side and the second adjacent side have substantially the same length, wherein the lances are adapted to be deformed back towards the electrical conductor to form a stapled connection of the first connection section to the FFC cable with only the lances at the staple feature, and wherein each lance comprises a first conductor contact area on a first side of the lance and a second conductor contact area on a second opposite side of the lance.

20. A flex cable electrical contact as in claim 19 wherein each lance has a general flat shape with a uniform cross section along its height except at its pointed tip and a base of the lance.

21. A flex cable electrical contact as in claim 19 wherein a first one of the staple features comprises only two of the lances.

22. A flex cable and electrical contact assembly comprising:

a flexible flat conductor (FFC) cable having an electrical conductor with a thickness of the electrical conductor of about 0.008 inch or more; and an electrical contact as in claim 19 connected to the FFC cable, wherein the lances are deformed such that they comprise inwardly curved deformed surfaces contacting outwardly curved deformed surfaces of the electrical conductor.

* * * * *